US007701152B2

(12) United States Patent
Williams

(10) Patent No.: US 7,701,152 B2
(45) Date of Patent: Apr. 20, 2010

(54) METHOD AND CIRCUIT FOR CONTROLLING OPERATION OF A LIGHT-EMITTING DIODE

(75) Inventor: Kenneth L Williams, Sherman, TX (US)

(73) Assignee: Texas Instruments Incorporated, Dallas, TX (US)

( * ) Notice: Subject to any disclaimer, the term of this patent is extended or adjusted under 35 U.S.C. 154(b) by 325 days.

(21) Appl. No.: 11/941,236

(22) Filed: Nov. 16, 2007

(65) Prior Publication Data

US 2008/0116827 A1 May 22, 2008

Related U.S. Application Data

(60) Provisional application No. 60/866,884, filed on Nov. 22, 2006.

(51) Int. Cl.
*H05B 37/02* (2006.01)

(52) U.S. Cl. ..... 315/360; 315/247; 315/291

(58) Field of Classification Search ..... 315/246–247, 315/291, 293–295, 297, 299, 307–308, 360; 323/211, 237, 263, 283, 288; 363/21.05, 363/21.1, 21.11, 21.13, 21.18, 26, 41, 119
See application file for complete search history.

(56) References Cited

U.S. PATENT DOCUMENTS 4,638,163 A 1/1987 Braunlich et al.
5,932,975 A 8/1999 Wut
6,333,607 B1 * 12/2001 Yamamoto et al. ..... 315/307
6,801,028 B2 * 10/2004 Kernahan et al. ..... 323/283
7,378,805 B2 * 5/2008 Oh et al. ..... 315/291
7,599,201 B2 * 10/2009 Okada ..... 363/41

* cited by examiner

*Primary Examiner*—David Hung Vu
*Assistant Examiner*—Tung X Le
(74) *Attorney, Agent, or Firm*—William B. Kempler; Wade J. Brady, III; Frederick J. Telecky, Jr.

(57) ABSTRACT

A light-emitting diode control circuit is provided, that includes: a duration selection circuit for selecting one of a first duration value, a second duration value, a third duration value, or a fourth duration value as a selected duration value based on a selection signal; a control clock generator for generating a control clock signal based on a slow clock signal and the selected duration value; a selection signal generator for generating the selection signal based on the control clock signal; an intensity signal generator for generating a current intensity signal based on a first intensity value, a second intensity value, the control clock signal, and the selection signal; a reference wave generator for generating a reference wave based on a fast clock signal; and a comparator for comparing the current intensity signal and the reference wave to generate a pulse width modulation signal to control the light-emitting diode.

25 Claims, 7 Drawing Sheets

METHOD AND CIRCUIT FOR CONTROLLING OPERATION OF A LIGHT-EMITTING DIODE

CROSS-REFERENCE TO RELATED APPLICATIONS

This application claims the benefit of the following provisional application: 60/866,884 filed Nov. 22, 2006, which is expressly incorporated herein by reference.

TECHNICAL FIELD

The technical field relates in general to the operation of light-emitting diodes (LEDs), and more specifically to a circuit and related method for controlling the fading on and off of LEDs.

BACKGROUND

Light-emitting diodes (LEDs) are semiconductor diodes that are designed to emit light of a particular wavelength when properly biased. Currently, LEDs are used in a variety of electronic devices for informational display, aesthetic display, or simply to provide light.

In general operation, an LED is either on (i.e., it is properly biased and is giving off light), or it is off (i.e., it is not properly biased and is off). Thus, when turned on, there is only one real intensity at which an LED can shine—its full intensity.

However, it is possible to create the appearance that the LED is being lit at a lower intensity by very quickly turning the LED on and off at a speed not discernable to the naked eye. The rapid switching of the diode on and off will reduce the total amount of light that the LED emits over a short period of time, making it seem as if the LED is actually emitting light at an intensity lower than the full intensity it would emit were it on continually.

This can be accomplished by generating a control signal for the LED that is rapidly changed from an on value that will bias the LED and turn it on to an off value that will turn the LED off. The exact frequency and duration at which the control signal turns the LED on will determine the perceived intensity of the LED.

This phenomenon can also be used to make it appear as if the LED is moving more gradually from an off state to a fully on state. If an LED is simply turned fully on or fully off, the transition between off and on will be abrupt, which can be displeasing to the eye. But by slowly increasing the amount of time that an LED is turned on over a set duration from constantly off state (i.e., gradually increasing its duty cycle from zero to 100%), the LED can be made to appear as if it is slowly fading from off to its maximum intensity. Likewise, by slowly decreasing the amount of time that an LED is turned on over a set duration from a constantly on state (i.e., gradually decreasing its duty cycle from 100% to zero), the LED can be made to appear as if it is slowly fading from its maximum intensity to off.

In order to accomplish this, however, it is necessary to generate an LED control signal that has a proper shape to appropriately vary the duty cycle of the LED to achieve a desired level of fading. Typically this is done by filling a set of registers with the data required to generate an appropriate LED control signal that will provide the desired duty cycle pattern for the required fading.

However, this approach is inherently limited in that only those fading patterns that are stored in memory can be used. Furthermore, changing fading patterns requires the loading of an entire new fading pattern in the control registers, which takes time and system resources.

It would therefore be desirable to provide a way to automatically vary the duty cycle of an LED in a manner that allows a variety of fading parameters to be easily varied.

SUMMARY

Accordingly, one or more embodiments provide a light-emitting diode control circuit. The control circuit comprises: a duration selection circuit for selecting one of a first duration value, a second duration value, a third duration value, or a fourth duration value as a selected duration value based on a selection signal; a control clock generator for generating a control clock signal based on a slow clock signal and the selected duration value; a selection signal generator for generating the selection signal based on the control clock signal; an intensity signal generator for generating a current intensity signal based on a first intensity value, a second intensity value, the control clock signal, and the selection signal; a reference wave generator for generating a reference wave based on a fast clock signal; and a comparator for comparing the current intensity signal and the reference wave to generate a pulse width modulation signal to control the light-emitting diode.

A method of controlling operation of a light-emitting diode is also provided, and comprises: generating a reference waveform; generating a fade-on signal during a first time period as a first function of a first intensity value, a second intensity value, and the first time period; comparing the fade-on signal to the reference waveform during the first time period; and generating a digital pulse-width modulation signal during the first time period based on the comparison of the fade-on signal to the reference waveform, wherein the light-emitting diode is turned on when the pulse-width modulation signal has a first value, wherein the light-emitting diode is turned off when the pulse-width modulation signal has a second value, and wherein the first intensity value is lower than the second intensity value.

A control circuit for controlling operation of a light-emitting diode is provided, comprising: means for generating a reference waveform; means for generating an intensity control signal as a function of a first time period, a second time period, a third time period, a fourth time period, a first intensity, and a second intensity; and means for generating a digital pulse-width modulation signal by comparing the intensity control signal to the reference waveform, wherein the light-emitting diode is turned on when the pulse-width modulation signal has a first value, wherein the light-emitting diode is turned off when the pulse-width modulation signal has a second value, and wherein the second time period is after the first time period, the third time period is after the second time period, and the fourth time period is after the third time period.

BRIEF DESCRIPTION OF THE DRAWINGS

The accompanying figures, where like reference numerals refer to identical or functionally similar elements and which together with the detailed description below are incorporated in and form part of the specification, serve to further illustrate various exemplary embodiments and to explain various principles and advantages in accordance with the embodiments.

DETAILED DESCRIPTION

Figure 1:
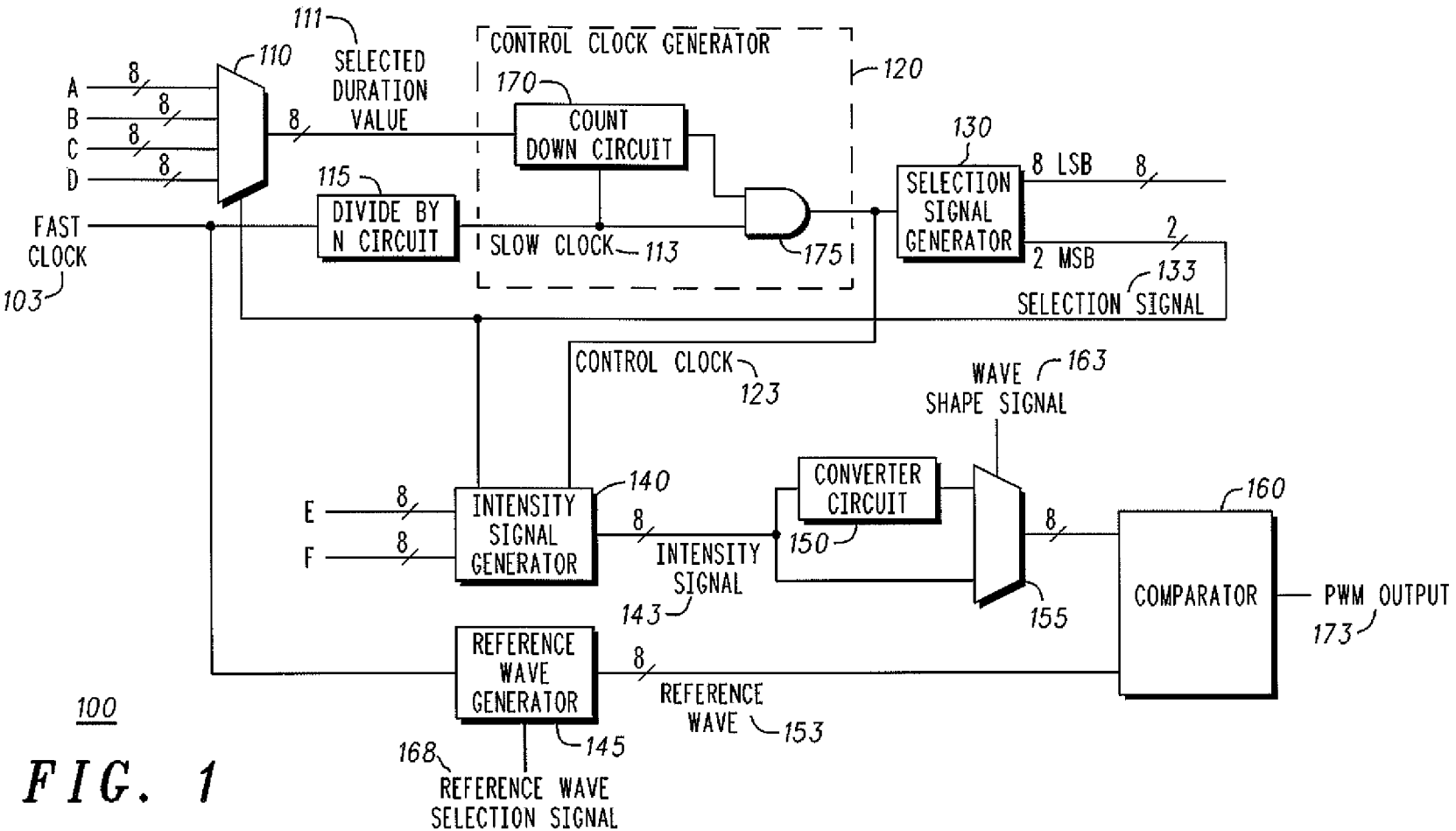
FIG. 1 is a block diagram showing a circuit for controlling the fading of a light-emitting diode according to disclosed embodiments.

In overview, the present disclosure concerns the control of a light-emitting diode (LED), particularly the variation of the LED's apparent intensity by dynamically adjusting its duty cycle. More specifically, it relates to a circuit and related method for generating an LED control signal that will dynamically adjust the duty cycle (and thus fading parameters) of an LED through the use of a small number of digital parameters, which can be easily varied.

This objective of generating an appropriate LED control signal is accomplished by using the digital parameters to set starting and ending effective LED intensities.

The instant disclosure is provided to further explain in an enabling fashion the best modes of performing one or more embodiments. The disclosure is further offered to enhance an understanding and appreciation for the inventive principles and advantages thereof, rather than to limit in any manner the invention. The invention is defined solely by the appended claims including any amendments made during the pendency of this application and all equivalents of those claims as issued.

It is further understood that the use of relational terms such as first and second, and the like, if any, are used solely to distinguish one from another entity, item, or action without necessarily requiring or implying any actual such relationship or order between such entities, items or actions. It is noted that some embodiments may include a plurality of processes or steps, which can be performed in any order, unless expressly and necessarily limited to a particular order; i.e., processes or steps that are not so limited may be performed in any order.

In addition, although throughout the disclosure active signals are referred to as being high (i.e., having a value of "1"), and inactive signals are referred to as being low (i.e., having a value of "0"), this is by way of example only. Alternate embodiments may be used that employ active low and inactive high signals, and the circuits described below may be modified to account for such changes.

Also, while the disclosure repeatedly refers simply to the intensity of an LED, it is understood that this is actually the effective intensity, achieved by properly setting the duty cycle of the LED to make it appear as if it has the desired intensity. Only at 100% duty cycle will the selected intensity be equal to the actual intensity. However, for ease of disclosure, the term intensity will be used to refer to the effective intensity.

Much of the inventive functionality and many of the inventive principles when implemented, are best supported with or in software or integrated circuits (ICs), such as a digital signal processor and software therefore, and/or application specific ICs. It is expected that one of ordinary skill, notwithstanding possibly significant effort and many design choices motivated by, for example, available time, current technology, and economic considerations, when guided by the concepts and principles disclosed herein will be readily capable of generating such software instructions or ICs with minimal experimentation. Therefore, in the interest of brevity and minimization of any risk of obscuring principles and concepts, further discussion of such software and ICs, if any, will be limited to the essentials with respect to the principles and concepts used by the exemplary embodiments.

As further discussed herein below, various inventive principles and combinations thereof are advantageously employed to reduce increase the amount of cross-regulation among power outputs of a switched-mode power converter, thereby reducing the maximum power drift across the power outputs.

Circuit for Controlling the Fading of a Light-Emitting Diode

FIG. 1 is a block diagram showing an LED control circuit 100, which is a circuit for controlling the fading of a light-emitting diode (LED) according to disclosed embodiments. This circuit could also be called a blinker or dimmer module. As shown in FIG. 1, the LED control circuit 100 includes a multiplexer 110, a divide-by-N circuit 115, a control clock generator 120, a selection signal generator 130, an intensity signal generator 140, a reference wave generator 145, a converter circuit 150, a multiplexer 155, and a comparator 160. The control clock generator 120 further comprises a count down circuit 170 and an AND gate 175.

The LED control circuit 100 of FIG. 1 generates a pulse width modulation (PWM) output based only on a fast clock and six digital values: A, B, C, D, E, and F. The PWM output is used to turn an LED on and off in a manner that will obtain a desired light intensity pattern for the LED. In this embodiment A, B, C, D, E, and F are all 8-bit digital values. However alternate embodiments could vary this using larger or smaller digital values.

The multiplexer 110 receives four of the digital values (duration parameters A, B, C, and D) that correspond to the durations of four different periods of operation of an LED: a fade-on period (A), a maximum intensity period (B), a fade-off period (C), and a minimum intensity period (D). The fade-on duration parameter A represents the time period over which the LED will fade from a minimum intensity to a maximum intensity; the maximum intensity parameter B represents the time period over which the LED will maintain the maximum intensity, the fade-off parameter C represents the time period over which the LED will fade from a maximum intensity to a minimum intensity, and the minimum intensity period D represents the time period over which the LED will maintain the minimum intensity.

The multiplexer 110 outputs one of these duration parameters (A, B, C, and D) to the control clock generator as a selected duration value 111 based on a selection signal 133 received from the selection signal generator 130.

In the disclosed embodiment, the duration parameters A, B, C, and D are each digital values that define a respective duration, from zero to a maximum allowable duration. The digital duration parameters A, B, C, and D are used in conjunction with the frequency of a slow clock 113 (see below) to set the actual time for their respective periods.

The divide-by-N circuit 115 receives a fast clock 103 (e.g., a main system clock), and divides the fast clock 103 by an integer value to generate a slow clock 113 having a lower frequency than the fast clock 103. An alternate embodiment could remove the divide-by-N circuit 115 entirely and provide the slow clock 113 in another manner. In some embodiments the slow clock 113 may be derived from the fast clock 103; in other embodiments the slow clock 113 will be independent from the fast clock 103.

The control clock generator 120 receives the selected duration value 111 and the slow clock 113 and uses these to generate a control clock 123 whose period is equal to the period of the slow clock 113 multiplied by the selected duration value 111. For example, in one embodiment the period of the slow clock 113 is 250 μs. If the selected duration value 111 is 1, the period of the control clock will also be 250 μs; if the selected duration value 111 is 3, the period of the control clock will be 750 μs (i.e. 3*250 μs); and if the selected duration value 111 is 255, the period of the control clock will 63.75 ms (i.e. 255*250 μs).

In the particular embodiment disclosed in FIG. 1, the count down circuit 170 receives the selected duration value 111 and the slow clock 113 and counts down a number of pulses of the slow clock 113 equal to the selected duration parameter, outputting a value of "1" only when the count down circuit finishes counting down the selected duration value 111.

The AND gate 175 receives the slow clock 113 and the output of the count down circuit 170 and performs a logical AND operation on the two signals to generate the control clock. In other words, the AND gate 175 only outputs a control clock pulse every time a number of slow clock pulses have passed equal to the selected duration value 111. Thus, the period of the control clock 123 will be equal to the period of the slow clock 113 multiplied by the selected duration value 111.

The selection signal generator 130 receives the control clock 123 and uses it to generate the selection signal 133, which can change periodically based on the control clock 123. This selection signal 133 is then used to control operation of the multiplexer 110 to select one of the duration parameters (A, B, C, and D) as a selected duration value 111.

In the disclosed embodiment, the selection signal generator 130 is a circular 10-*bit* up counter driven by the control clock 123, and the selection signal 133 is made up of the two most significant bits (MSBs) of the output of the selection signal generator 130. These two MSBs decode four states that change every 256 cycles of the control clock 123. Alternate embodiments could use a larger or smaller up counter, or could provide an entirely different circuit altogether to generate the selection signal 133.

In some embodiments, selection signal generator 130 can be arranged such that it may be preset to a desired state in order to start the intensity signal at a point other than the beginning of the fade-on period. In other embodiments the selection signal generator 130 could be modified to produce a repeating pattern of multiple intensity pulses with different fully-off times between them, controlled by additional timing parameters. In still other embodiments, the selection signal generator 130 could be arranged to allow a single fade-on or fade-off process and then maintain a maximum or minimum intensity for an extended duration. In this case, the fade-on or fade-off would be a single operation rather than a repeated operation.

Although the selection signal changes regularly based on a number received cycles from the control clock 123, the durations of the values of the selection signal 133 are not necessarily identical. Because the period of the control clock 123 can change based on the value of the selected duration value 111, the duration during which each of the values of the selection signal 133 are valid will also vary based on the value of the selected duration value 111. Thus, the value of the duration parameters A, B, C, and D will therefore determine the duration of their corresponding operations.

The intensity signal generator 140 generates an intensity signal that represents a desired intensity of the LED. This intensity signal can vary between a maximum intensity value E and a minimum intensity value F. It will generally fade on slowly during the fade-on period, stay even at the maximum intensity during the maximum intensity period, fade off slowly during the fade-off period, and stay even at the minimum intensity during the minimum intensity period. In order to coordinate the timing of these periods, the intensity signal generator 140 receives the same selection signal 133 that the multiplexer 110 does.

The reference wave generator 145 operates to generate a reference wave 153, which is provided to the comparator. This reference wave could be a sawtooth wave, a logarithmic wave, or any other desired wave type that will work with the intensity signal 143 to generate an appropriate PWM output.

In the disclosed embodiment, the reference wave generator 145 uses the fast clock 103 to generate the reference wave. In alternate embodiments, the reference wave generator 145 may operate based on a different clock signal.

In some embodiments the reference wave generator 145 can selectively provide multiple reference waves based on a reference wave selection signal 168. For example, the reference wave generator 145 could be designed to provide a sawtooth wave or an logarithmic wave. In other embodiments, the reference wave generator 145 could be designed to provide only a single type of wave. In such embodiments, it need not receive a wave shape signal 168.

The converter circuit 150 is provided in some embodiments to convert a linear intensity signal 143 based on a nonlinear function into a nonlinear intensity signal. In one particular embodiment, the converter circuit 150 converts the linear intensity signal 143 into an exponential signal.

The multiplexer 155 operates to choose either the linear intensity signal or a nonlinear signal output from the converter circuit 150 based on the Wave shape signal 163.

In embodiments in which only a linear intensity signal 143 (or only a nonlinear signal) is used, the converter circuit 150 and the multiplexer 155 can be eliminated, and the linear intensity signal 143 (or nonlinear signal) provided directly to the comparator 160. In other embodiments in which only a nonlinear intensity signal is used, the functions of the converter circuit 150 can be incorporated into the intensity signal generator 140.

The comparator 160 compares the output of the multiplexer 155 (i.e. an intensity) with the reference wave 153 to generate the PWM output. If the intensity is greater than or equal to the reference wave 153, then the PWM output is low; and if the intensity is less than the reference wave 153, then the PWM output is high. In this embodiment a logic low value is chosen to turn the LED on. Alternate embodiments could reverse this, in which case the operation of the comparator would be adjusted according to generate the proper PWM signal.

The frequency of the PWM output is determined by the frequency of the reference wave 153. In one embodiment the frequency of the PWM output is set to be approximately 125 Hz, which is high enough that no blinking or flickering in the LED will be perceived by the unaided human eye. Alternate embodiments can vary this frequency as desired, however.

Although the embodiment of FIG. 1 specifically discloses multiplexers 110 and 155 to select among a plurality of input circuits, this is by way of example only. Alternate embodiments could use different kinds of selection circuits to achieve these functions.

Although only one LED control circuit 100 is shown in FIG. 1, alternate embodiments could employ multiple LED control circuits 100 in a single integrated circuit, allowing multiple, different, simultaneous blinking effects. These LED controllers could be in synchronization (i.e., all fading-on or fading off at the same time), juxtaposed (i.e., some fading-on as others are fading-off), arranged in any other desired pattern (e.g., fading on and off in a wave), or simply operating independently from each other.

The Output Intensity Signal and the Pulse Width Modulated Output

Figure 2:
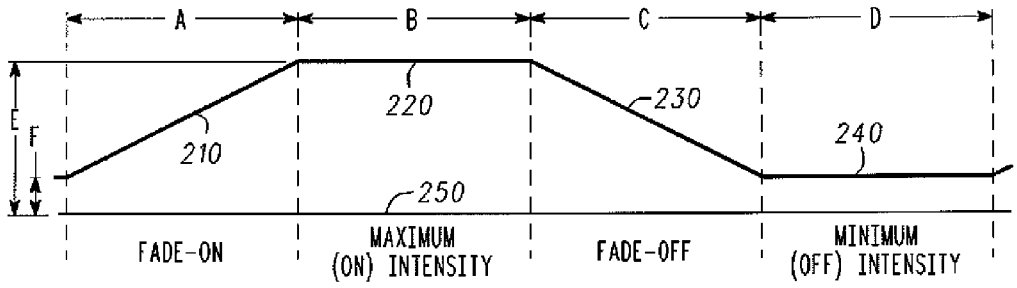
FIG. 2 is a graph of a linear intensity signal of FIG. 1 according to disclosed embodiments.

FIG. 2 is a graph of a linear intensity signal of FIG. 1 according to disclosed embodiments. This shows one embodiment of the output of the intensity signal generator 140 of FIG. 1. As shown in FIG. 2, the intensity signal 200 behaves differently in four separate time periods: a fade-on period A, a maximum intensity period B, a fade-off period C, and a minimum intensity period D.

During the fade-on period A the intensity signal is a fade-on signal 210 that moves from the intensity F to the intensity E over the duration of the fade-on period A.

During the maximum intensity period B (also called the ON period), the intensity signal is a maximum intensity signal 220 that maintains a constant maximum intensity value E. This maximum intensity may be an absolute maximum value (i.e., in which the LED is on during the entire period B) or a relative maximum value for the duration of the maximum intensity period B.

During the fade-off period C the intensity signal is a fade-off signal 230 that moves from the intensity E to the intensity F over the duration of the fade-off period C. The intensities F and E are both measured with respect to a zero intensity line 250, indicative of a zero intensity when the LED is fully off.

During the minimum intensity period D (also called the OFF period), the intensity signal is a minimum intensity signal 240 that maintains a constant minimum intensity value F. This minimum intensity may be an absolute minimum value (i.e., in which the LED is off during the entire period D) or a relative minimum value for the duration of the minimum intensity period D.

Figure 3:
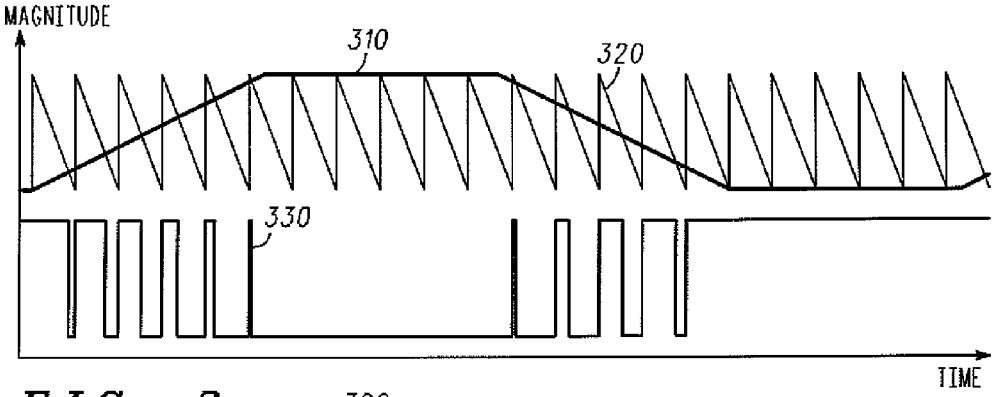
FIG. 3 is a graph of an intensity signal, a reference wave, and a pulse-width modulation output of the circuit of FIG. 1 according to disclosed embodiments.

FIG. 3 is a graph of an intensity signal, a reference wave, and a pulse-width modulation (PWM output of the circuit of FIG. 1 according to disclosed embodiments. As shown in FIG. 3, the intensity signal 310 is compared with the reference wave 320 to generate the PWM output 330. This PWM output is then used to drive an LED to turn on and off quickly, giving the appearance of an intensity pattern that matches the intensity signal 310.

The intensity signal 310 represents a desired LED output intensity over the fade-on period A, the maximum intensity period B, the fade-off period C, and the minimum intensity period. In the embodiment of FIG. 1, this corresponds to the output of the intensity signal generator 140 or the multiplexer 155.

The reference wave 320 represents a wave that will be compared to the intensity signal 310 to generate the PWM output 330. In the disclosed embodiment, the reference wave 320 is a sawtooth wave. In alternate embodiments in which the intensity signal had an exponential function, the reference wave could be a logarithmic wave.

The PWM output 330 represents a signal used to turn on and off an LED. It is generated by comparing the intensity signal 310 to the reference wave 320. When the intensity signal 310 is greater than or equal to the reference wave 320, the PWM output 330 is low, indicating that the LED should be turned on. When the intensity signal 310 is les that the reference wave 320, the PWM output 330 is high, indicating that the LED should be turned off. Alternate embodiments could reverse this such that the LED was turned off when the PWM output 330 was low and turned on when the PWM output 330 was low. In such a case, the comparison of intensity signal 310 and the reference wave 320 should be adjusted as well to provide a correct PWM output 330.

Figure 4:
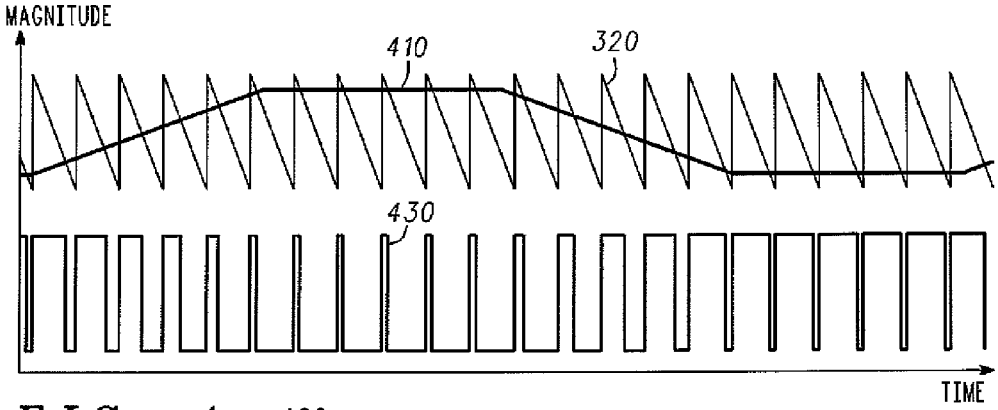
FIG. 4 is a graph of an intensity signal, a reference wave, and a pulse-width modulation output of the circuit of FIG. 1 according to alternate disclosed embodiments.

FIG. 4 is a graph of an intensity signal, a reference wave, and a pulse-width modulation output of the circuit of FIG. 1 according to alternate disclosed embodiments. As shown in FIG. 4, the intensity signal 410 is compared with the reference wave 320 to generate the PWM output 430.

The embodiment of FIG. 4 operates just as the embodiment of FIG. 3, except that the maximum value of the intensity signal 310 is set below the highest possible intensity value, while the minimum value of the intensity signal 310 is set above zero. Thus, while in the embodiment of FIG. 3, the resulting PWM output 330 will instruct the LED to be fully on during the maximum intensity period, and fully off during the minimum intensity period, the embodiment of FIG. 4 varies the intensity of the LED between a two intermediate intensities, never turning the LED fully off or fully on.

Alternate embodiments could vary the position of the minimum intensity from zero (i.e., totally off) up to somewhere below the maximum intensity, and could vary the position of the maximum intensity from an absolute maximum (i.e., totally on) down to somewhere above the minimum intensity.

Figure 5:
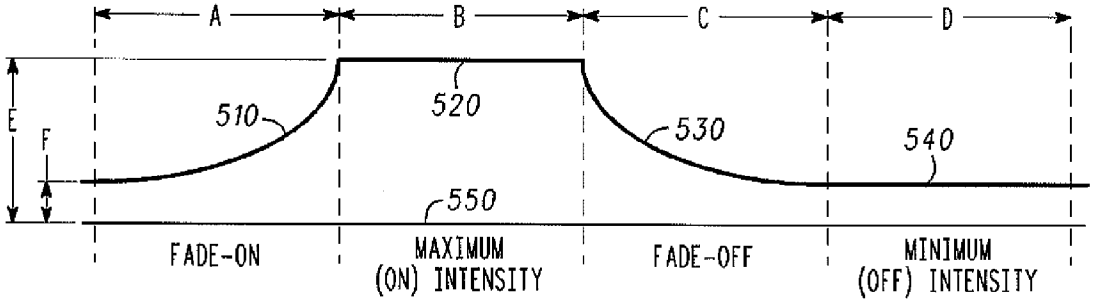
FIG. 5 is a graph of an exponential intensity signal of FIG. 1 according to disclosed embodiments.

FIG. 5 is a graph of an output intensity value of a light-emitting diode that is faded on and off using an exponential function according to disclosed embodiments. As shown in FIG. 5, the intensity signal 500 behaves differently in four separate time periods: a fade-on period A having a fade-on intensity signal 510, a maximum intensity period B having a maximum intensity signal 520, a fade-off period C having a fade-off intensity signal 530, and a minimum intensity period D having a minimum intensity signal 540.

The operation of the embodiment of FIG. 5 operates as the embodiment of FIG. 2, except that the fade-on and fade-off functions are nonlinear, causing the fade-on intensity signal 510 and the fade-off intensity signal 530 to be nonlinear as well.

As with FIG. 2, the intensities F and E are both measured with respect to a zero intensity line 550, indicative of a zero intensity when the LED is fully off.

In the embodiments of FIGS. 3-5, the reference signal is a sawtooth wave. This is shown by way of example only. Alternate embodiments could employ a different reference wave that could be compared to an intensity wave to produce an appropriate PWM output. One example of such a wave would be a logarithmic wave.

In addition, although in the embodiments of FIGS. 2-5, the fade-on period A, the maximum intensity period B, the fade-off period C, and the minimum intensity period D are shown as being of equivalent lengths, this is by way of example only. In such an embodiment, the LED is uniformly faded on, kept lit at a maximum intensity, faded off, and kept lit at a minimum intensity In alternate embodiments, however, the lengths of the periods A, B, C, and D can be varied such that any or all have unique values. In doing so, the particular speed at which the LED fades on and off can be controlled, as can the time that the LED is brightly lit or kept dim or dark. This can allow a wide variety of display options for the LED. In some embodiments one or more of these periods may have zero value. In this case, the system would effectively skip over that period. In the embodiment of FIG. 1, this is achieved by varying the 8-bit values for the duration parameters A, B, C, and D.

For example, in one embodiment, the value for the maximum intensity period B could be set to zero. In this case, the fade-off operation would take place immediately after the fade-on operation, meaning the LED would not be turned on and then off without any time shining at a maximum intensity. In another embodiment the fade-on period A and the fade-off period C could be comparatively short, while the maximum intensity period B and the minimum intensity period could be comparatively long. Numerous other permutations of values for the periods A, B, C, and D are possible.

In addition, although FIGS. 2-5 disclose only one iteration of the periods A, B, C, and D, this pattern could be repeated over and over again, with the period D leading right into the period A in a later iteration.

Intensity Signal Generator

Figure 6:
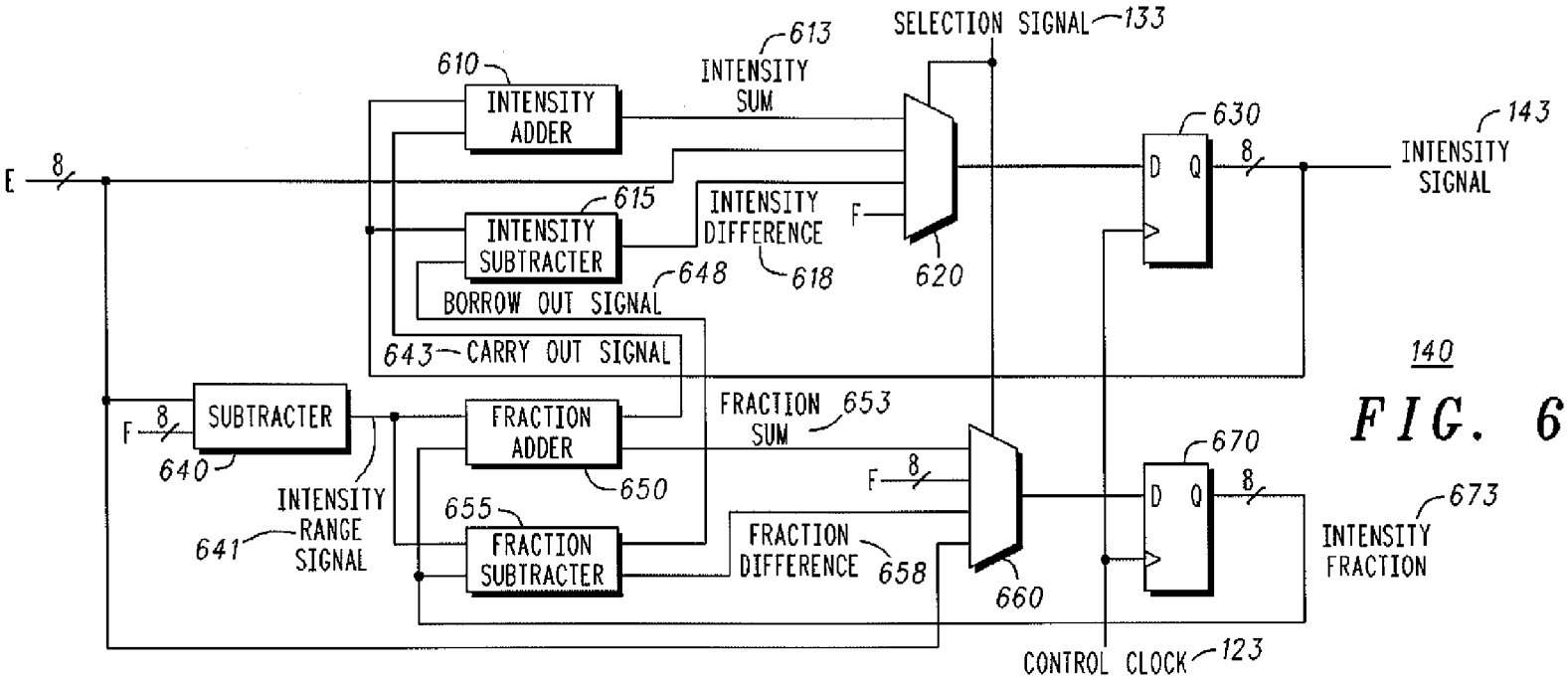
FIG. 6 is a block diagram of the intensity signal generator of FIG. 1 according to disclosed embodiments.

FIG. 6 is a block diagram of the intensity signal generator 140 of FIG. 1 according to disclosed embodiments. As shown in FIG. 6, the intensity signal generator 140 includes an intensity adder 610, an intensity subtractor 615, an intensity multiplexer 620, an intensity flip-flop 630, a subtractor 640, a fraction adder 650, a fraction subtractor 655, a fraction multiplexer 660, and a fraction flip-flop 670.

The intensity adder 610 adds together the intensity signal 143 and the carry out signal 643 to generate an intensity sum 613, which is used during a fade-on period A to generate the intensity signal 143.

The intensity subtractor 615 subtracts the borrow out signal 648 from the intensity signal 143 to generate an intensity difference 618, which is used during a fade-off period C to generate the intensity signal 143.

The intensity multiplexer 620 selects one of the intensity sum 613, the intensity difference 618, the maximum intensity value E, and the minimum intensity value F as the intensity signal 143 based on the selection signal 133 received from the selection signal generator 130. During a fade-on period A the intensity multiplexer 620 selects the intensity sum 613 as the intensity signal 143; during the maximum intensity period B the intensity multiplexer 620 selects the maximum intensity value E as the intensity signal 143; during the fade-off period C the intensity multiplexer 620 selects the intensity difference 618 as the intensity signal 143; and during the minimum intensity period D the intensity multiplexer 620 selects the minimum intensity value F as the intensity signal 143.

The intensity flip-flop 630 receives the output of the intensity multiplexer 620 and latches onto it as a current intensity signal based on the control clock 123. This isolates a current intensity signal 143 and allows the intensity adder 610 and the intensity subtractor 615 to use it to generate a new intensity signal 143.

The subtractor 640 operates to generate an intensity range signal 641 equal to the difference between the maximum intensity value E and the minimum intensity value F. This intensity range signal 641 represents the total rise in intensity the LED must experience during a fade-on period A and the total drop in intensity the LED must experience during a fade-off period C.

The fraction adder 650 adds together the intensity fraction 673 and the intensity range signal 641 in a modulo addition operation to generate a fraction sum 653 with an equal number of bits as the intensity range signal (i.e., 8-bits in the disclosed embodiment). The fraction sum 653 is used during a fade-on period A to generate the intensity fraction 673.

The fraction adder 650 also generates a carry out signal 643 that indicates whether the modulo addition of the intensity fraction 673 and the intensity range signal 641 caused the sum to wrap around. The carry out signal 643 has a value of 1 when there was a wrap around, and a value of 0 when there is no wrap around.

The fraction subtractor 655 subtracts the intensity range signal 641 from the intensity fraction 673 in a modulo subtraction operation to generate a fraction difference 658 with an equal number of bits as the intensity range signal (i.e., 8-bits in the disclosed embodiment). The fraction difference 658 is used during a fade-off period C to generate the intensity fraction 673.

The fraction subtractor 655 also generates a borrow out signal 648 that indicates whether the modulo subtraction of the intensity range signal from the intensity fraction 673 caused the difference to wrap around. The borrow out signal 648 has a value of 1 when there was a wrap around, and a value of 0 when there is no wrap around.

The fraction multiplexer 660 selects one of the fraction sum 653, the fraction difference 658, the maximum intensity value F, and the minimum intensity value P as the intensity fraction 673 based on the selection signal 133 received from the selection signal generator 130. During a fade-on period A the fraction multiplexer 660 selects the fraction sum 653 as the intensity fraction 673; during the maximum intensity period B the fraction multiplexer 660 selects the minimum intensity value F as the intensity fraction 673; during the fade-off period C the fraction multiplexer 660 selects the fraction difference 658 as the intensity fraction 673; and during the minimum intensity period D the fraction multiplexer 660 selects the maximum intensity value E as the intensity fraction 673.

The fraction flip-flop 670 receives the output of the fraction multiplexer 660 and latches onto it as a current intensity fraction based on the control clock. This isolates a current intensity fraction 173 and allows the fraction adder 650 and the fraction subtractor 655 to use it to generate a new intensity fraction 173.

Method of Controlling the Fading of a Light-Emitting Diode

Figure 7:
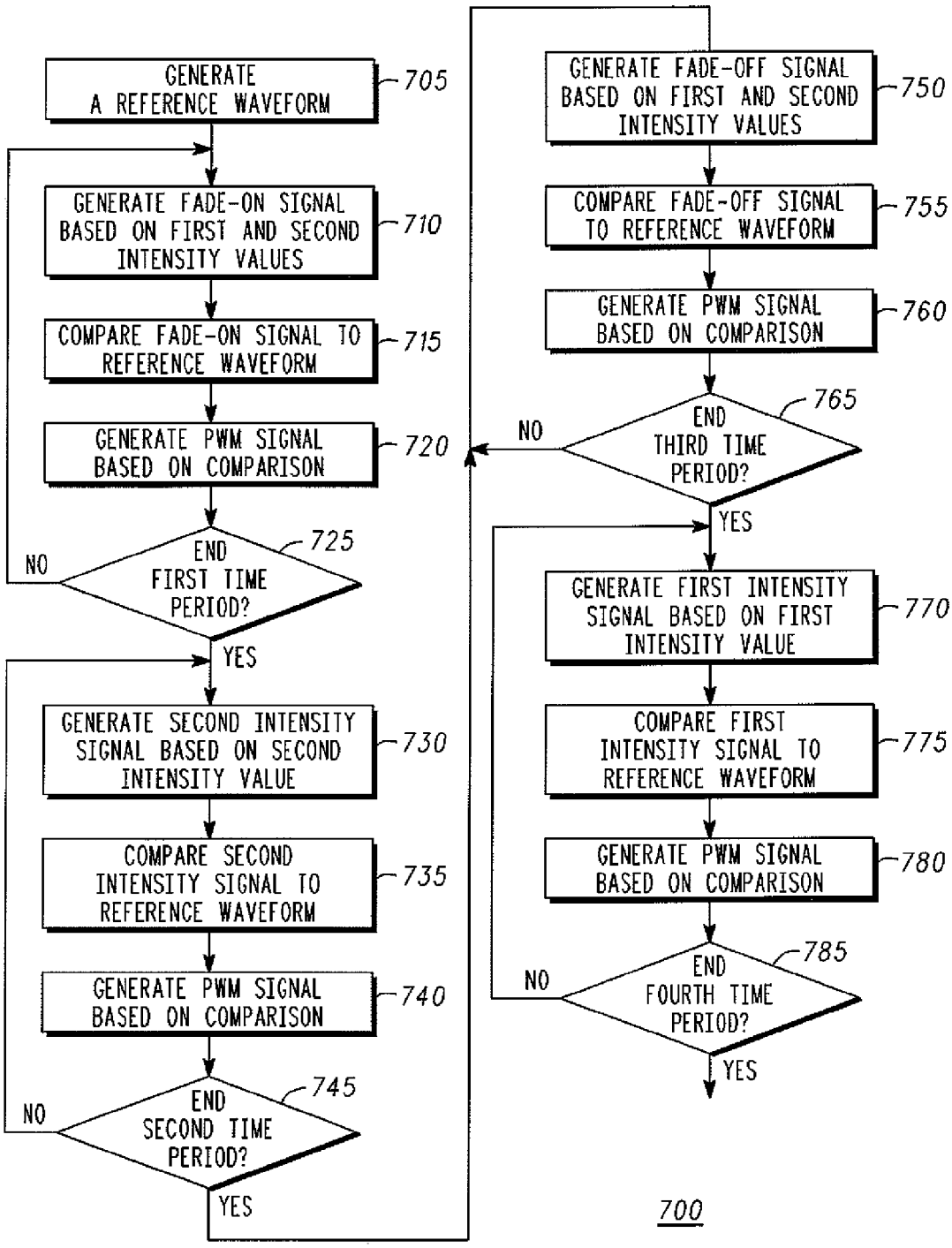
FIG. 7 is a flow chart showing an operation of controlling the fading of a light-emitting diode according to disclosed embodiments.

FIG. 7 is a flow chart showing an operation of controlling the fading of a light-emitting diode (LED) according to disclosed embodiments.

As shown in FIG. 7, the process 700 begins when a device generates a reference waveform (705). This reference waveform can be a saw-tooth waveform, as shown in FIGS. 3 and 4, or another appropriate reference waveform, as desired.

The process 700 then begins a fade-on operation by generating a value for a fade-on signal 210, 510 based on a first intensity value F and a second intensity value E (710). This can be accomplished, for example, by stepping the fade-on signal 210, 510 up from F to E according to a set formula over the course of the first time period.

As the fade-on signal is generated, the process 700 compares the fade-on signal to the reference waveform (715), and generates a pulse width modulation (PWM signal to control the LED based on the comparison (720). This can be accomplished as shown above with respect to FIGS. 3 and 4.

As the process 700 performs the fade-on operation (710-725), it repeatedly determines whether the first time period (i.e., the time period A for the fade-on operation) has ended (725). If the first time period hasn't ended, the process continues to perform the fade-on operation (710-725). But if the first time period has ended, the process 700 proceeds to a second time period for a maximum intensity operation.

The process 700 then begins the maximum intensity operation by generating a maximum intensity signal based on the second intensity value E (730). This can be accomplished, for example, by setting the maximum intensity signal to second intensity value E.

As the maximum intensity signal is generated, the process 700 compares the maximum intensity signal to the reference waveform (735), and generates a pulse width modulation (PWM) signal to control the LED based on the comparison (740). This can be accomplished as shown above with respect to FIGS. 3 and 4.

As the process 700 performs the maximum intensity operation (730-745), it repeatedly determines whether the second time period (i.e., the time period B for the maximum intensity operation) has ended (745). If the second time period hasn't ended, the process continues to perform the maximum intensity operation (730-745). But if the second time period has ended, the process 700 proceeds to a third time period for a fade-off operation.

The process 700 then begins a fade-off operation by generating a value for a fade-off signal 210, 510 based on a first intensity value F and a second intensity value E (750). This can be accomplished, for example, by stepping the fade-off signal 210, 510 down from E to F according to a set formula over the course of the third time period.

As the fade-off signal is generated, the process 700 compares the fade-off signal to the reference waveform (755), and generates a pulse width modulation (PWM) signal to control the LED based on the comparison (760). This can be accomplished as shown above with respect to FIGS. 3 and 4.

As the process 700 performs the fade-off operation (750-765), it repeatedly determines whether the third time period (i.e., the time period C for the fade-off operation) has ended (765). If the third time period hasn't ended, the process continues to perform the fade-off operation (750-765). But if the third time period has ended, the process 700 proceeds to a fourth time period for a minimum intensity operation.

The process 700 then begins the minimum intensity operation by generating a minimum intensity signal based on the first intensity value F (770). This can be accomplished, for example, by setting the minimum intensity signal to first intensity value F.

As the minimum intensity signal is generated, the process 700 compares the minimum intensity signal to the reference waveform (775), and generates a pulse width modulation (PWM) signal to control the LED based on the comparison (780). This can be accomplished as shown above with respect to FIGS. 3 and 4.

As the process 700 performs the minimum intensity operation (770-785), it repeatedly determines whether the fourth time period (i.e., the time period D for the minimum intensity operation) has ended (785). If the fourth time period hasn't ended, the process continues to perform the minimum intensity operation (770-785). But if the fourth time period has ended, the process 700, the process 700 can either end or repeat again. If repeated, the values of the first, second, third, and fourth time periods, as well as the first and second intensity values could remain the same or could in whole, or in part, be changed. If repeated, the operation of generating a reference waveform (705) is continued throughout the process.

Although FIG. 7 describes a process 700 in which a fade-on operation (710-725) is performed first, this is by way of example only. The control of an LED could start with any of the first intensity operation (770-785), the second intensity operation (730-745), or the fade-off operation (750-765). However, in whatever order these operations are performed, the second intensity operation (730-745) should come after the fade-on operation (710-725), the fade-off operation (750-765) should come after the second intensity operation (730-745), the first intensity operation (770-785) should come after the fade-off operation (750-765), and the fade-on operation (710-725) should come after the first intensity operation (770-785).

In addition, either of the first intensity operation (770-785) or the second intensity operation (730-745) could be eliminated in alternate embodiments. In such embodiments, if the first intensity operation (770-785) were eliminated the fade-on operation (710-725) would come after the fade-off operation (750-765), and if the second intensity operation (730-745) were eliminated the fade-off operation (750-765) would come after the fade-on operation (710-725).

Method of Setting an Intensity Signal

Figure 8A:
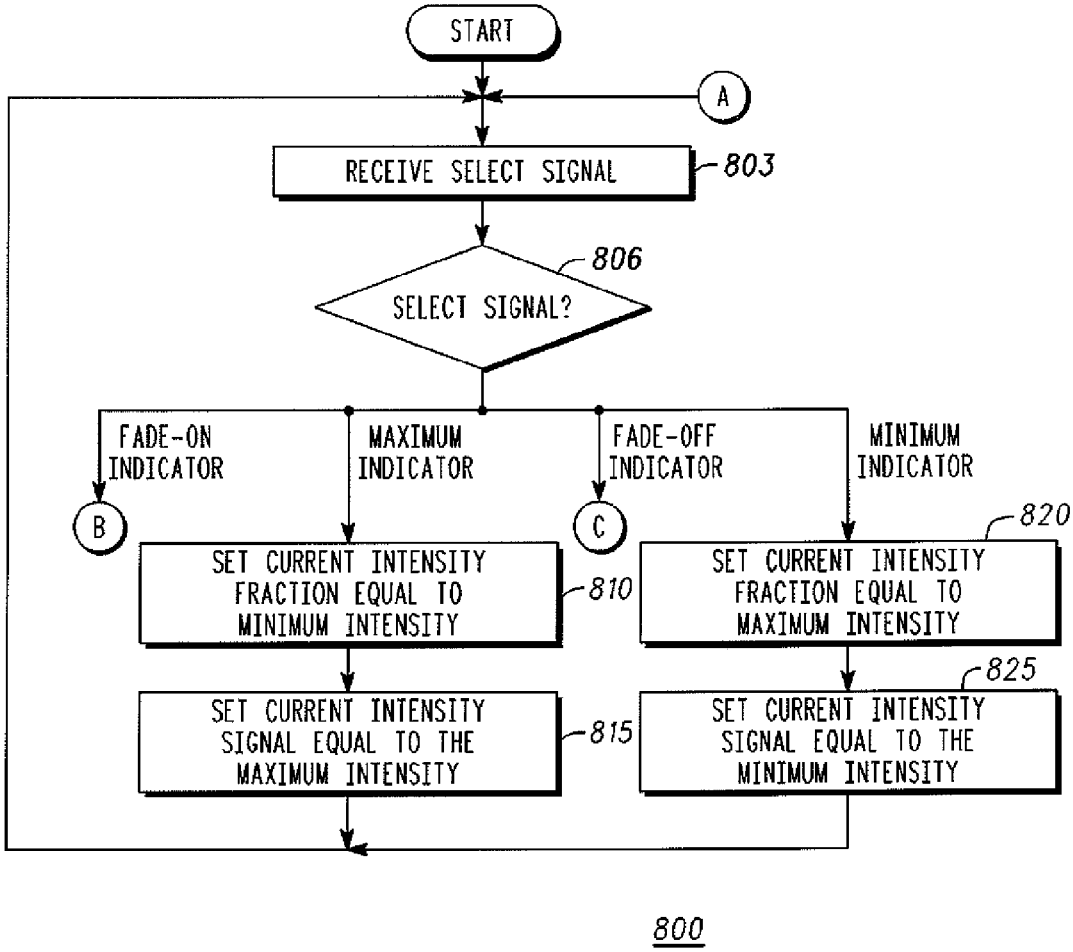
FIGS. 8A, 8B, and 8C are flow charts showing an operation of setting an intensity signal according to disclosed embodiments.

FIGS. 8A, SB, and 8C are flow charts showing an operation of setting an intensity signal according to disclosed embodiments.

Figure 8B:
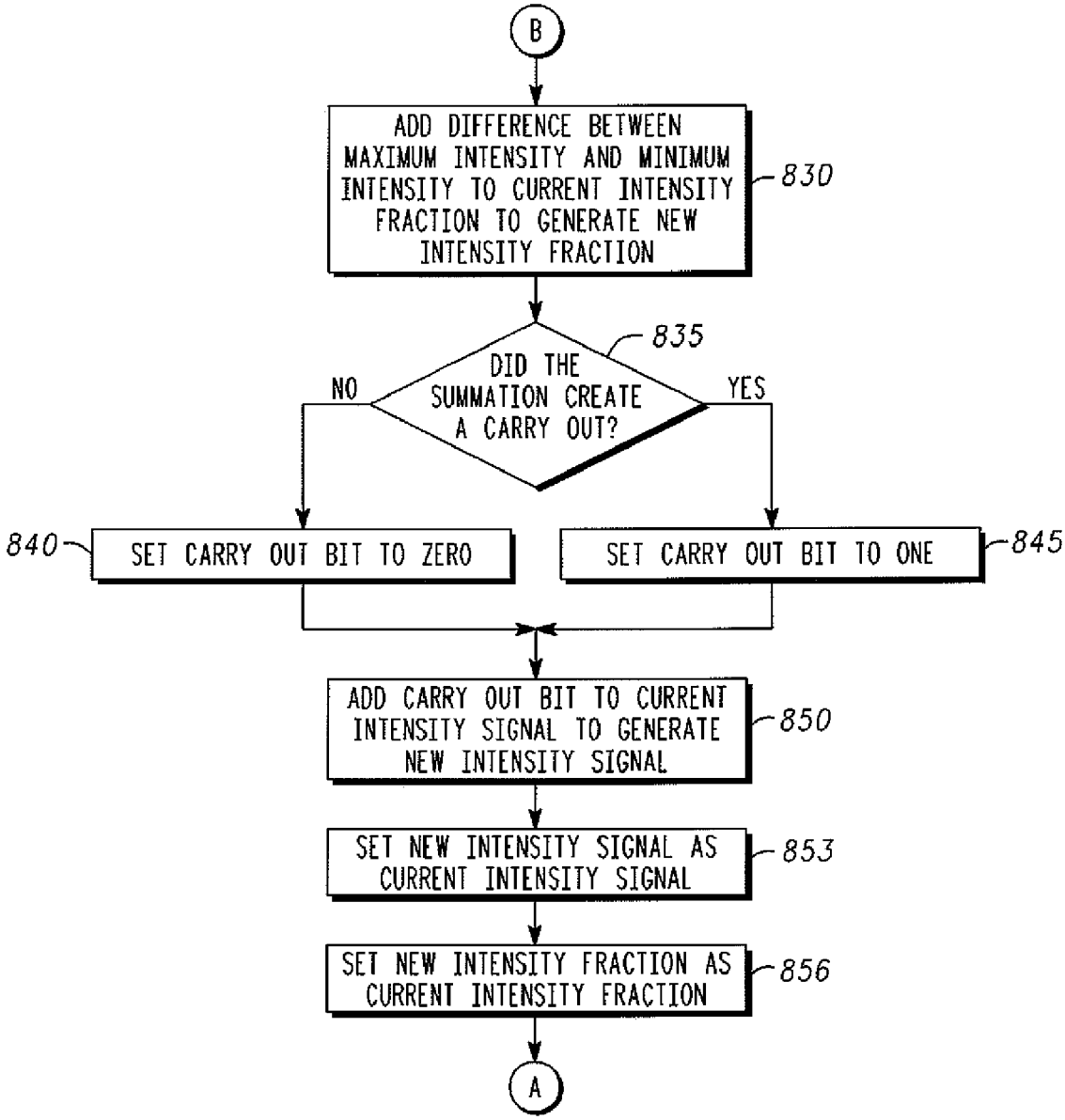
Figure 8C:
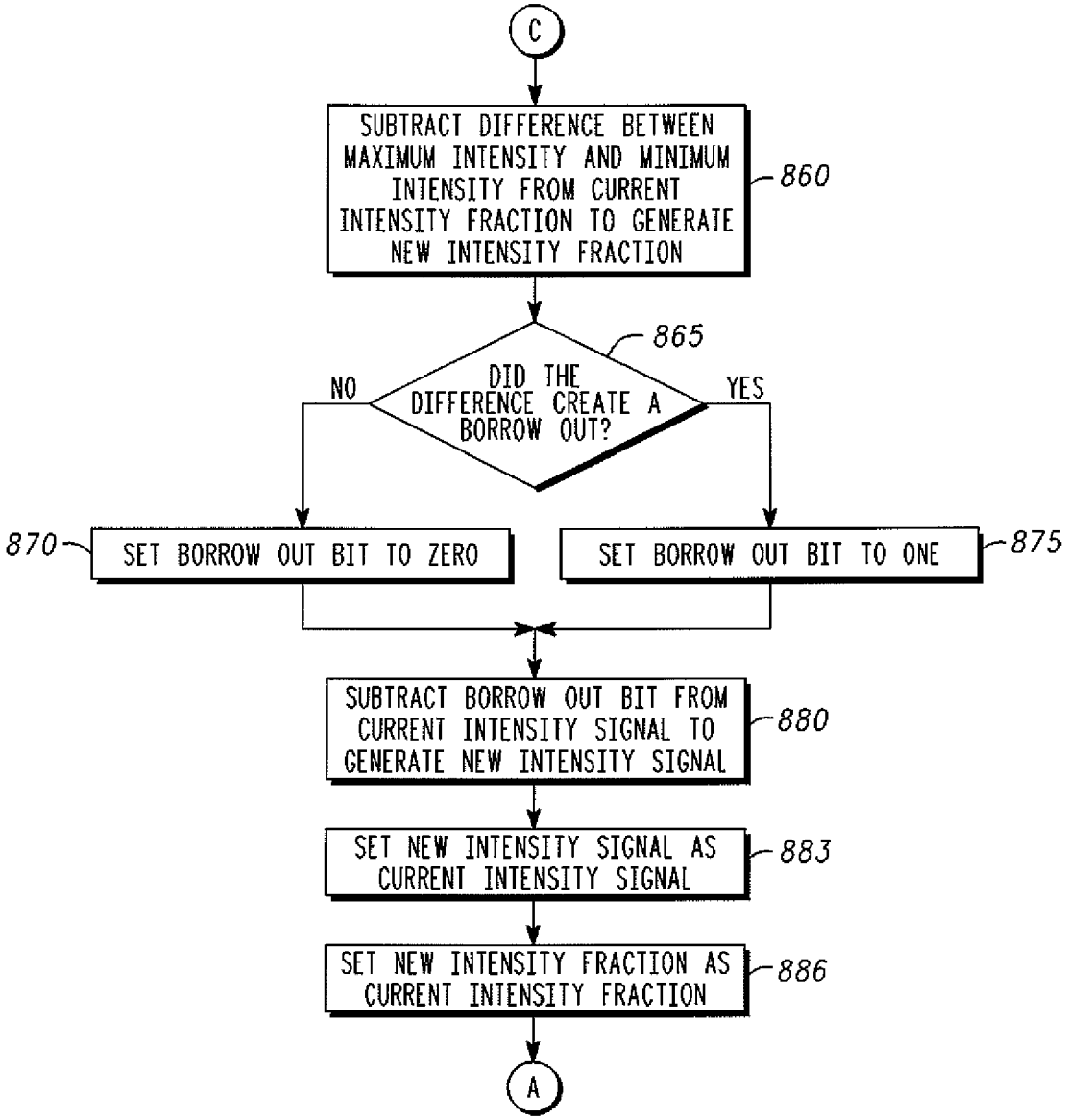

As shown in FIGS. 8A, 8B, and 8C, the process 800 begins with the receipt of a select signal (e.g., the select signal 133 from FIG. 1) (803), and the determination of the values of the select signal (806). In the disclosed embodiment, the select signal can have a fade-on indicator value, a maximum indicator value, a fade-off indicator value, and a minimum indicator value.

If the select signal has the fade-on indicator value (806), the process 800 performs a fade-on operation. This fade-on operation begins by adding the difference between a maximum intensity value E (indicative of a maximum LED intensity desired) and a minimum intensity value F (indicative of a minimum LED intensity desired) to a current intensity fraction to generate a new intensity fraction (830).

This summation is performed as a modulo summation based on the number of bits that define the maximum and minimum intensity values E and F, such that if the sum wraps around, a carry out is generated. Therefore, when this summation is performed it's necessary to determine if the carry out is generated (835).

If the carry out was not generated, a carry out bit is set to 0 (840); and if the carry out was generated, the carry out bit is set to 1 (845).

This carry out bit is then added to the current intensity signal to generate a new intensity signal (850), the new intensity signal is set as the current intensity signal (853), and the new intensity fraction is set as the current intensity fraction (856).

In this way, the intensity fraction is incremented every cycle, but the intensity signal is only incremented when there is a carry out. This allows the intensity signal to evenly step up from the minimum intensity F to the maximum intensity E over the course of the fade-on period A, regardless of what values are chosen for F and E.

Examples of how this fade-on process is performed are shown in Tables One and Two. Table One shows the operation of an intensity calculator for 8-bit values in which the quantity (E−F) is equal to 255. Table Two shows the operation of an intensity calculator for 8-bit values in which the quantity (E−F) is equal to 127. In this particular embodiment, in fact, the value for F is 0, so (E−F)=E.

TABLE ONE

Intensity Calculator for Region A (E − F = 255)

| Control Clock Cycle | Intensity Integer | Intensity Fraction | Carry Out |
|---|---|---|---|
| 0 | 0 | 255 | 0 |
| 1 | 1 | 254 | 1 |

TABLE ONE-continued

| Intensity Calculator for Region A (E – F = 255) | | | |
|---|---|---|---|
| Control Clock Cycle | Intensity Integer | Intensity Fraction | Carry Out |
| 2 | 2 | 253 | 1 |
| 3 | 3 | 252 | 1 |
| . . . | . . . | . . . | . . . |
| 252 | 252 | 3 | 1 |
| 253 | 253 | 2 | 1 |
| 254 | 254 | 1 | 1 |
| 255 | 255 | 0 | 1 |

As shown in Table One, when the value of (E–F) is at a maximum, the carryout is 1 in all clock cycles after the first. As a result, the intensity integer is incremented each clock cycle and reaches the maximum at the $256^{th}$ control clock cycle.

As shown in Table Two, when the value of (E–F) is not at a maximum, the carryout is 1 in some of the clock cycles and 0 in others. As a result, the intensity integer is incremented only during some clock cycles. These increments are spread out to make the rise even, and equal in number to the range between the maximum value E and the minimum value F. As a result, this will cause a linear rise from the minimum value to the maximum value over the course of the fade-on process.

TABLE TWO

| Intensity Calculator for Region A (E = 127) | | | |
|---|---|---|---|
| Control Clock Cycle | Intensity Integer | Intensity Fraction | Carry Out |
| 0 | 0 | 127 | 0 |
| 1 | 0 | 254 | 0 |
| 2 | 1 | 125 | 1 |
| 3 | 1 | 252 | 0 |
| 4 | 2 | 131 | 1 |
| 5 | 2 | 131 | 0 |
| . . . | . . . | . . . | . . . |
| 250 | 124 | 133 | 1 |
| 251 | 125 | 4 | 0 |
| 252 | 125 | 131 | 1 |
| 253 | 126 | 2 | 0 |
| 254 | 126 | 129 | 1 |
| 255 | 127 | 0 | 0 |

In these two examples, the intensity integer begins at a value of 0 and the intensity fraction begins at a value of 255, since those were the values that were set there during a minimum intensity operation, which would precede a fade-on operation.

If the select signal has the maximum indicator value (806), the process 800 performs a maximum intensity operation. This maximum intensity operation is performed by setting a current intensity fraction equal to the minimum intensity F (810) and setting the current intensity signal equal to the maximum intensity E (815). In this way, the current intensity signal is kept constant at the maximum intensity E, while the current intensity fraction is set to the minimum intensity F in preparation for a fade-off process.

If the select signal has the fade-off indicator value (806), the process 800 performs a fade-off operation. This fade-off operation begins by subtracting the difference between the maximum intensity E and the minimum intensity F from a current intensity fraction to generate a new intensity fraction (860).

This subtraction is performed as a modulo subtraction based on the number of bits that define the maximum and minimum intensity values E and F, such that if the difference wraps around, a borrow out is generated. Therefore, when this subtraction is performed it's necessary to determine if the borrow out is generated (865).

If the borrow out was not generated, a borrow out bit is set to 0 (870); and if the borrow out was generated, the borrow out bit is set to 1 (875).

This borrow out bit is then subtracted from the current intensity signal to generate a new intensity signal (880), the new intensity signal is set as the current intensity signal (883), and the new intensity fraction is set as the current intensity fraction (886).

In this way, the intensity fraction is decremented every cycle, but the intensity signal is only decremented when there is a borrow out. This allows the intensity signal to evenly step down from the maximum intensity E to the minimum intensity F over the course of the fade-off period C, regardless of what values are chosen for F and E.

If the select signal has the minimum indicator value (806), the process 800 performs a minimum intensity operation. This minimum intensity is performed by setting a current intensity fraction equal to the maximum intensity E (820) and setting the current intensity signal equal to the minimum intensity F (825). In this way, the current intensity signal is kept constant at the minimum intensity value F, while the current intensity fraction is set to the maximum intensity E in preparation for a fade-on process.

At the end of each of the fade-on operation, maximum intensity operation, fade-off operation, and minimum intensity operation, the process 800 again receives a current select signal (803) and determines what value the select signal has (806).

As shown in FIGS. 7, 8A, 8B, and 8C, using the disclosed operations, a pulse width modulation (PWM) output can be generated using at most six digital values. A controller need only have a value for the fade-on duration A, the maximum intensity duration B, the fade-off duration C, the minimum intensity duration D, the maximum intensity value E, and the minimum intensity value F, and the resulting PWM output can be generated.

Furthermore, this PWM output is completely scalable as values of A, B, C, D, E, and F change. There is no need to change a table of values stored in a memory. Each time the PWM output needs to be generated, it is easily derived from the current values of A, B, C, D, E.

In this way, the LED controller can dynamically control a fading operation (fading on or fading oft) using only a handful of control signals and minimal system resources.

CONCLUSION

This disclosure is intended to explain how to fashion and use various embodiments in accordance with the invention rather than to limit the true, intended, and fair scope and spirit thereof. The invention is defined solely by the appended claims, as they may be amended during the pendency of this application for patent, and all equivalents thereof. The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated.

All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A light-emitting diode control circuit, comprising:

a duration selection circuit for selecting one of a first duration value, a second duration value, a third duration value, or a fourth duration value as a selected duration value based on a selection signal;

a control clock generator for generating a control clock signal based on a slow clock signal and the selected duration value;

a selection signal generator for generating the selection signal based on the control clock signal;

an intensity signal generator for generating a current intensity signal based on a first intensity value, a second intensity value, the control clock signal, and the selection signal;

a reference wave generator for generating a reference wave based on a fast clock signal; and a comparator for comparing the current intensity signal and the reference wave to generate a pulse width modulation signal to control the light-emitting diode.

2. The light-emitting diode control circuit of claim 1, wherein the control clock generator comprises:

a count-down circuit for receiving the selected duration value and generating a count-down signal that is active only after the passage of a number of cycles of the slow clock equal to the selected duration value; and an AND gate for receiving the divided clock signal and the count-down signal and generating the control clock, the control clock being active only when the slow clock signal and the count-down signal are both active.

3. The light-emitting diode control circuit of claim 1, wherein the selection signal generator toggles through a plurality of possible selection values for the selection signal by counting the number of times the control clock is active.

4. The light-emitting diode control circuit of claim 1, wherein the reference wave is one of a sawtooth wave and a logarithmic wave.

5. The light-emitting diode control circuit of claim 1, wherein when the selection signal has a first selection value, the intensity signal moves from the first intensity value to the second intensity value according to a first function, when the selection signal has a second selection value, the intensity signal maintains the second intensity value, when the selection signal has a third selection value, the intensity signal moves from the second intensity value to the first intensity value according to a second function, and when the selection signal has a fourth selection value, the intensity signal maintains the first intensity value.

6. The light-emitting diode control circuit of claim 1, wherein the intensity signal generator further comprises:

a fraction adder for adding an intensity range to a current intensity fraction in a modulo addition function to generate a fraction sum and a carry out signal indicative of whether the fraction sum rolls over;

a fraction subtractor for subtracting the intensity range from the current intensity fraction in a modulo subtraction function to generate a fraction difference and a borrow out signal indicative of whether the fraction difference rolls under;

a fraction selector for selecting one of the fraction sum, the fraction difference, the first intensity value, and the second intensity value as a new intensity fraction based on the selection signal;

an intensity adder for adding the carry over signal to the current intensity signal to generate an intensity sum;

an intensity subtractor for subtracting the borrow over signal from the current intensity signal to generate an intensity difference; and an intensity selector for selecting one of the intensity sum, the intensity difference, the first intensity value, and the second intensity value as a new intensity signal based on the selection signal.

7. The light-emitting diode control circuit of claim 6, wherein the carry out signal has a value of 1 when the fraction sum rolls over and a value of 0 when the fraction sum does not roll over, and wherein the borrow out signal has a value of 1 when the fraction difference rolls under and a value of 0 when the fraction difference does not roll under.

8. The light-emitting diode control circuit of claim 6, wherein when the selection signal has a first value the intensity selector selects the intensity sum as the new intensity signal, and the fractional selector selects the fraction sum as the new intensity fraction, wherein when the selection signal has a second value the intensity selector selects the first intensity value as the new intensity signal, and the fractional selector selects the second intensity value as the new intensity fraction, wherein when the selection signal has a third value the intensity selector selects the intensity difference as the new intensity signal, and the fractional selector selects the fraction difference as the new intensity fraction, and wherein when the selection signal has a fourth value the intensity selector selects the second intensity value as the new intensity signal, and the fractional selector selects the first intensity value as the new intensity fraction.

9. The light-emitting diode control circuit of claim 6, wherein the intensity range is equal to a difference between the first intensity value and the second intensity value.

10. The light-emitting diode control circuit of claim 1, wherein the second intensity value is a maximum intensity value for the light-emitting diode, and wherein the first intensity value is a minimum intensity value for the light-emitting diode.

11. A method of controlling operation of a light-emitting diode, comprising:

generating a reference waveform;

generating a fade-on signal during a first time period as a first function of a first intensity value, a second intensity value, and the first time period;

comparing the fade-on signal to the reference waveform during the first time period; and generating a digital pulse-width modulation signal during the first time period based on the comparison of the fade-on signal to the reference waveform, wherein the light-emitting diode is turned on when the pulse-width modulation signal has a first value, wherein the light-emitting diode is turned off when the pulse-width modulation signal has a second value, and wherein the first intensity value is lower than the second intensity value.

12. The method of claim 11, wherein the second intensity value is a maximum intensity value for the light-emitting diode, and wherein the first intensity value is a minimum intensity value for the light-emitting diode.

13. The method of claim 11, wherein the first function is one of: a linear function and an exponential function.

14. The method of claim 11, wherein the reference wave is one of a sawtooth wave and a logarithmic wave.

15. The method of claim 11, further comprising:

comparing the second intensity value to the reference waveform during a second time period; and generating the digital pulse-width modulation signal during the second time period based on the comparison of the second intensity value to the reference waveform, wherein the second time period is after the first time period.

16. The method of claim 15, further comprising:

generating a fade-off signal during a third time period as a second function of the first intensity value, the second intensity value, and the third time period;

comparing the fade-off signal to the reference waveform during the third time period; and generating the digital pulse-width modulation signal during the third time period based on the comparison of the fade-off signal to the reference waveform, wherein the third time period is after the second time period.

17. The method of claim 16, wherein the second function is one of: a linear function and an exponential function.

18. The method of claim 16, further comprising:

comparing the third intensity value to the reference waveform during a fourth time period; and generating the digital pulse-width modulation signal during the fourth time period based on the comparison of the third intensity value to the reference waveform, wherein the fourth time period is after the third time period.

19. The method of claim 16, wherein when the fade-off signal is greater than the reference waveform the pulse-width modulation signal is set to the first value, and wherein when the fade-off signal is lower than the reference waveform the pulse-width modulation signal is set to the second value.

20. The method of claim 11, wherein when the fade-on signal is greater than the reference waveform the pulse-width modulation signal is set to the first value, and wherein when the fade-on signal is lower than the reference waveform the pulse-width modulation signal is set to the second value.

21. A control circuit for controlling operation of a light-emitting diode, comprising:

means for generating a reference waveform;

means for generating an intensity control signal as a function of a first time period, a second time period, a third time period, a fourth time period, a first intensity, and a second intensity; and means for generating a digital pulse-width modulation signal by comparing the intensity control signal to the reference waveform, wherein the light-emitting diode is turned on when the pulse-width modulation signal has a first value, wherein the light-emitting diode is turned off when the pulse-width modulation signal has a second value, and wherein the second time period is after the first time period, the third time period is after the second time period, and the fourth time period is after the third time period.

22. The control circuit of claim 21, wherein during the first time period, the intensity control signal is a function of the first intensity and the second intensity.

23. The control circuit of claim 21, wherein during the third time period, the intensity control signal is a function of the first intensity and the second intensity.

24. The control circuit of claim 21, wherein during the second time period, the intensity control signal is equal to the second intensity, and wherein during the fourth time period, the intensity control signal is equal to the first intensity.

25. The control circuit of claim 21, wherein when the intensity control signal is greater than the reference waveform the pulse-width modulation signal is set to the first value, and wherein when the intensity control signal is lower than the reference waveform the pulse-width modulation signal is set to the second value.

* * * * *